US005579029A

United States Patent [19]

Arai et al.

[11] Patent Number: 5,579,029

[45] Date of Patent: Nov. 26, 1996

[54] DISPLAY APPARATUS HAVING AUTOMATIC ADJUSTING APPARATUS

[75] Inventors: Ikuya Arai; Kouji Kitou; Jun Miura, all of Yokohama, Japan

[73] Assignee: Hitachi, Ltd., Tokyo, Japan

[21] Appl. No.: 461,307

[22] Filed: Jun. 5, 1995

Related U.S. Application Data

[63] Continuation of Ser. No. 195,053, Feb. 14, 1994, abandoned, which is a continuation of Ser. No. 922,781, Jul. 31, 1992, abandoned.

[51] Int. Cl.[6] ..... G09G 5/12

[52] U.S. Cl. ..... 345/132; 345/213

[58] Field of Search ..... 345/3, 132, 173, 345/174, 175, 176, 213, 100; 348/521

[56] References Cited

U.S. PATENT DOCUMENTS

| | | | |
|---|---|---|---|
| 4,777,482 | 10/1988 | Kaneko et al. | 345/175 |
| 4,860,246 | 8/1989 | Inoue | 364/900 |
| 5,021,719 | 7/1991 | Arai et al. | 315/364 |
| 5,396,258 | 3/1995 | Zenda | 345/213 |
| 5,448,260 | 9/1995 | Zenda et al. | 345/100 |

FOREIGN PATENT DOCUMENTS

| | | |
|---|---|---|
| 63-247792 | 10/1988 | Japan . |
| 6-100887 | 12/1994 | Japan . |

*Primary Examiner*—Richard Hjerpe
*Assistant Examiner*—Lun-Yi Lao
*Attorney, Agent, or Firm*—Antonelli, Terry, Stout & Kraus

[57] ABSTRACT

It is an object to enable an optimum video display to be obtained by automatically adjusting a display size and a display position of a video image no matter what kind of video signal is supplied. A comparator detects a video display period of a video signal a and generates a detection signal b. A counter, latch circuits, comparing circuits, and the like form information of the start position or end position of the video display period of the video signal a and period information of the video signal a. An arithmetic operation control circuit generates control information of the display size, display position, and the like from those information by arithmetic operations by using a detection signal b and a horizontal sync signal h. A memory holds the control information. The control information is read out when a power source of the display is turned on at the next time.

64 Claims, 12 Drawing Sheets

DISPLAY APPARATUS HAVING AUTOMATIC ADJUSTING APPARATUS

This application is a continuation of application Ser. No. 08/195,053, filed Feb. 14, 1994, now abandoned, which is a continuation application of Ser. No. 07/922,781, filed Jul. 31, 1992 now abandoned.

BACKGROUND OF THE INVENTION

The invention relates to what is called a multiscan display in which, even when a horizontal deflecting frequency and a vertical deflecting frequency of an input video signal are different, the video signal can be correctly displayed in accordance with the horizontal or vertical deflecting frequency. More particularly, the invention relates to an automatic adjusting apparatus of a multiscan display which can provide the optimum video display automatically in correspondence to even a signal whose display timings such as blanking period and a video display period and the like of an input video signal are different.

At present, in a display of a computer terminal or the like, there are various kinds of display positions and display sizes of a video image on the screen and there are also various kinds of deflecting frequencies of an input video signal. Therefore, a multiscan display having a high generality such that a single display can cope with all of video signals is used.

In such a kind of display, there is a display which intends to provide the optimum video display every kind of video signal by using a microcomputer, a memory LSI, or the like. As such a conventional technique, for instance, there is a technique disclosed in JP-U-64-4491.

According to the technique mentioned above, a memory in which information regarding the display position and display size of the video image of each video signal has previously been stored is controlled by using a microcomputer, the information of the optimum display position and display size of the video image is read out from the memory in accordance with the input video signal, and a deflecting circuit of the multiscan display is controlled on the basis of the read-out information. The kind of video signal is judged by detecting a period of an input sync signal. Therefore, when the video signal which is supplied to the multiscan display has previously been known, the optimum video display can be provided.

On the other hand, there is also a technique such that even when the video signal which is supplied to the multiscan display is not preliminarily known, the optimum video display is provided in correspondence to the input video signal. Such a conventional technique, is disclosed in JP-A-1-321475 can be FIG. 12 is a block diagram showing a former multi-scan display device described in the prior reference, JP-A1-321475. In FIG. 12, reference numeral 21 denotes a signal input circuit, 22 a video pre-amplifier circuit, 23 a video output circuit, 24 a cathode ray tube and a deflection yoke (hereinafter referred to as CRT), 26 a horizontal phase adjust circuit, 27 a horizontal oscillation circuit, 28 a horizontal drive circuit, 29 a horizontal output circuit, 30 a high-voltage generator circuit, 31 a synchronizing signal processing and input signal identification circuit, 32 a vertical deflection circuit, 33 and 34 a user setting means, 35 a control circuit (hereinafter referred to as microcomputer), 36 an EEPROM, 37 frequency band selection decoder circuit, 38 a latch circuit (hereinafter referred to as a D/A converter).

In the display device shown in FIG. 12, a video signal sent from a personal computer is input to the signal input circuit. Then, when the input video signal is a composite video signal, a synchronizing separation circuit separates and extracts a synchronizing signal from the video signal and outputs the separated synchronizing signal to the synchronizing signal processing and input signal identification circuit 31.

On the other hand, when the video signal sent from the personal computer is a separated synchronizing signal, the video signal is directly input to the synchronizing signal processing and input signal identification circuit 31.

In the synchronizing signal processing and input signal identification circuit 31, the polarity of the input synchronizing signal is made the predetermined one and a horizontal synchronizing signal (H. SYNCH) is output to the horizontal phase adjust circuit 26, and a vertical synchronizing signal (V. SYNCH) is output to the vertical deflection circuit 32, respectively.

Furthermore, the video signal is identified by the frequency and polarity of the synchronizing signal and the signal mode of TTL input signal or analog input signal sent from the user setting means 33, and the identified signal is output to the control circuit comprising a microcomputer.

In the control circuit 35, the corresponding control data is read out from the EEPROM 36 and is arithmetically operated on the basis of the identified signal sent from the synchronizing signal processing and input signal identification circuit 31.

Furthermore, a band switching signal is output from a horizontal frequency identification decoder or a vertical frequency identification decoder included in a frequency band selection decoder circuit 37 to the horizontal output circuit 29, and the vertical deflection circuit 32, and thereby each control signal is output from DAC 1–8 of D/A converter 38.

The horizontal phase adjust circuit 26, the horizontal oscillation circuit 27, the horizontal drive circuit 28, the horizontal output circuit 29, and the vertical deflection circuit 32 form a so-called deflection circuit in the display device.

The horizontal phase adjust circuit 26 delays and adjusts the phase of the synchronizing signal by means of a horizontal position control signal from DAC 1 of the D/A converter 38 against the input horizontal synchronizing signal (H.SYNCH), and thereby the horizontal display position of the video signal displayed on a CRT 24 is adjusted.

Furthermore, a horizontal size control signal from DAC 2 is added to the horizontal output circuit 29 to adjust the horizontal display size.

Similarly, the vertical size control signal from DAC 5 and the vertical position from DAC 6 are output to the vertical deflection circuit 32 respectively to adjust the display position and display size.

The control data corresponding to the specific received signal has been previously stored in the EEPROM 36.

Accordingly, there exists no control data corresponding to the EEPROM 36 in accordance with the identification signals of the synchronizing signal processing and input signal identification circuit 31.

Thus, the control circuit 35 arithmetically operates in accordance with the control indicating signal supplied by the user setting means 34 to control the control signal of the D/A converters 38, and thereby the display size and position can be adjusted by a user.

According to such a technique as mentioned above, the operation similar to that in the foregoing conventional technique is executed to the known video signal, instruction signals to adjust the display position, display size, and the like of the video image are manually supplied from the outside of the multiscan display for the other video signals, and a microcomputer generates a control signal of a deflecting circuit on the basis of the input information. In this instance, the control signal can be registered into the memory as new information of the display position and display size of the video image. When the relevent video signal is supplied in the next or subsequent time, the video signal can be handled as a known signal.

In the above conventional technique, it is necessary to provide a step of storing the information of the display position and display size of the video image for the known video signal into the memory at the time of shipping from the factory. In this instance, there is a case where the information to be stored differs in dependence on the corresponding video signal and, even in case of the same video signal, the information to be stored also slightly differs due to a variation of each multiscan display. Therefore, the information of the display position and display size to give the optimum video display with every video signal needs to be set every multiscan display and to be stored into the memory. Thus, an adjusting apparatus and an adjusting time to write the above information into the memory are necessary.

Further, according to the conventional technique, since the input video signal is judged by a difference of the frequency or period of the input sync signal, there is a problem such that even when the sync signal frequency is equal, so long as another video signal of a different display timing (for example, blanking period, video display period, or front porch period) of the video image is supplied, the optimum video display is not obtained.

On the other hand, when an unknown video signal is supplied to the multiscan display, it is necessary for the user of the multiscan display to execute the manual adjustment in order to obtain the optimum video display and it is troublesome in terms of the using efficiency and convenience.

SUMMARY OF THE INVENTION

It is an object of the invention to provide an automatic adjusting apparatus for a multiscan display in which an adjusting apparatus and an adjusting time for writing information of the display position and display size of a video image for various kinds of video signals into a memory are unnecessary and, even in the case where a video signal in which a display timing of a video image differs although an equal sync signal frequency is equal, the optimum video display can be obtained and, further, even in the case where an unknown video signal is supplied, the user doesn't need to execute a manual adjustment.

To accomplish the above object, as a first construction, the invention is constructed by period detecting means, video display period detecting means, video position deriving means, arithmetic operation control means, and holding means.

According to the invention, the above construction is further provided with manual adjusting means for a manual adjustment.

On the other hand, to accomplish the above object, as a second construction, the invention is constructed by period detecting means, video detecting means, arithmetic operation control means, and holding means.

According to the invention, the above second construction is further provided with manual adjusting means for enabling the adjustment of the display size and display position to be manually set and sync signal polarity detecting means for detecting the polarity of an input sync signal.

According to the invention, the above second construction is further provided with blanking generating means.

In the above first construction, according to the invention, the period detecting means detects one horizontal period and one vertical period of a video signal and forms period information. The video display period detecting means detects video display periods (portions where a video image exists) in one horizontal period and one vertical period of the video signal. The video position deriving means detects start positions and end positions of the video display periods in one horizontal period and one vertical period on the basis of an output of the video display period detecting means and generates detection information. The arithmetic operation control means forms control information for controlling the display size and display position of the video image on the screen by a predetermined arithmetic operating method on the basis of the period information of the period detecting means and the detection information from the video position deriving means, thereby managing the control information. The holding means is managed by the arithmetic operation control means and holds the control information.

The holding means can also hold both of the detection information from the video position deriving means and the control information which has been calculated and formed on the basis of such detection information. The arithmetic operation control means fetches the detection information from the video position deriving means and compares with the detection information held in the holding means. When they coincide as a result of the comparison, the arithmetic operation is not executed but the corresponding control information in the holding means is read out. When they differ, the arithmetic operation is executed, the control information is formed, and both of the detection information and the control information are also written into the holding means.

The manual adjusting means manually adjust the display size and display position and give the adjustment information to the arithmetic operation control means.

In the above second construction, according to the invention, the video detecting means detects the display size and display position of the video image displayed on the screen. The arithmetic operation control means forms the control information of the optimum display size and display position corresponding to each input video signal from the output of the video detecting means by the arithmetic operation. The period detecting means detects horizontal and vertical periods of the video signal in order to provide video signal information. The sync signal polarity detecting means detects the polarity of the sync signal. The holding means holds the period information, the sync signal polarity information, and the control information.

The arithmetic operation control means calculates the blanking period of the video signal which is supplied or its start position or end position from the control information of the display size and display position, thereby forming blanking information. The blanking generating means forms a blanking signal from the blanking information.

From the above construction, the automatic adjusting apparatus of the multiscan display can automatically adjust the optimum display size and display position for any video signal.

BRIEF DESCRIPTION OF THE DRAWINGS

FIG. 1 is a block diagram showing the first embodiment of the invention;

DESCRIPTION OF THE PREFERRED EMBODIMENTS

Figure 9:
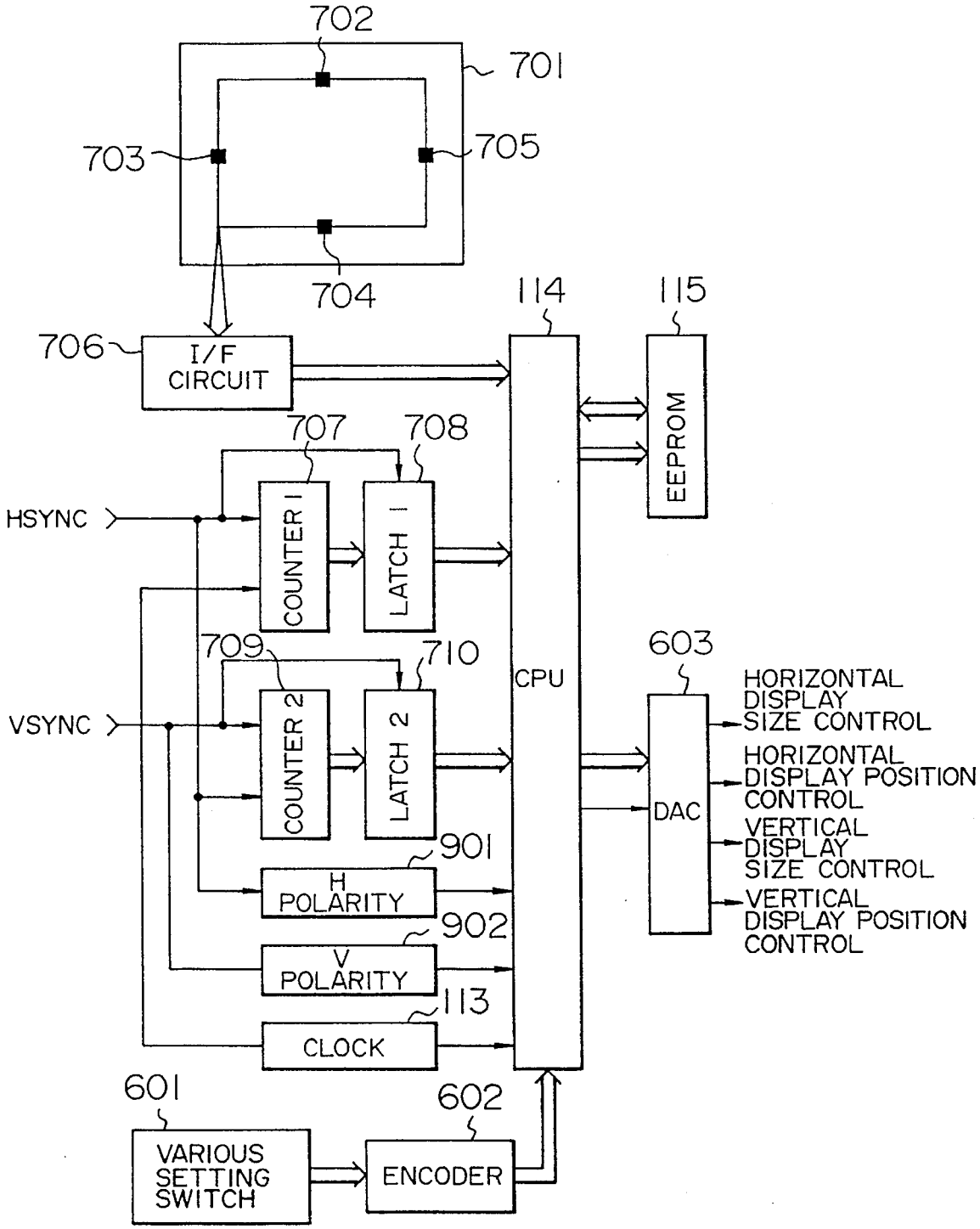
FIG. 9 is a block diagram showing the fifth embodiment of the invention.

Embodiments of the invention will be described hereinbelow with reference to the drawings.

FIG. 1 is a block diagram showing the first embodiment of the invention.

In FIG. 1, reference numeral 101 denotes a comparator; 102 a reference voltage source; 103 a counter; 104 a differentiating circuit; 105 and 109 AND circuits (hereinafter, referred to as AND); 106, 107, and 108 latch circuits; 110 and 111 comparing circuits; 112 an inverter; 113 a clock generating circuit; 114 an arithmetic operation control circuit (hereinafter, referred to as CPU); 115 a memory; and 116 a digital/analog converting circuit (hereinafter, referred to as a DAC) of two outputs.

The operation of the embodiment will now be described hereinbelow with reference to FIG. 2.

Figure 2:
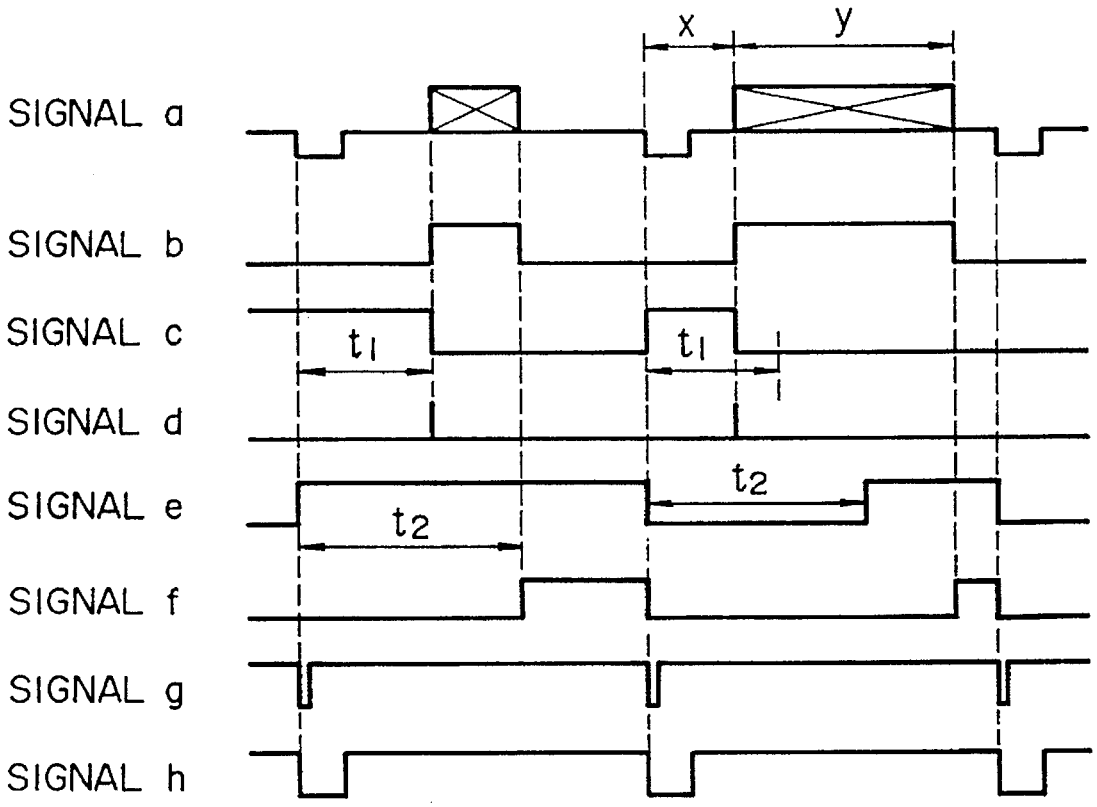
FIG. 2 is a waveform diagram showing waveforms of signals in main sections in FIG. 1.

FIG. 2 is a waveform diagram showing waveforms of signals in main sections in FIG. 1.

In FIG. 2, signals a to h correspond to reference characters a to h in FIG. 1.

The video signal a in FIG. 2 which is supplied to a multiscan display is distributed to a non-inversion signal input terminal of the comparator 101. A reference voltage of the reference voltage source 102 is supplied to another non-inversion signal input terminal of the comparator 101. The comparator 101 compares the reference voltage and the video signal a. Thus, the comparator 101 generates the detection signal b in FIG. 2 indicative of a video display period y.

On the other hand, the counter 103 counts the number of first clocks i which are generated from the clock generating circuit 113. The differentiating circuit 104 detects the trailing or leading edge of the horizontal sync signal h in FIG. 2 which is supplied to the multiscan display and forms the signal g in FIG. 2 having one clock width of the clock i. The signal g functions as a reset signal of the counter 103, so that the counter 103 executes the counting operation of one horizontal period.

A portion of the embodiment comprising the latch circuit 106, comparing circuit 110, and AND 105 functions to hold a count value of the counter 103 at the start position of the video display period y in the video signal a into the latch circuit 106.

That is, the comparing circuit 110 receives the output of the latch circuit 106 as a first input value A and the count value of the counter 103 as a second input value B and executes the comparing operation. When the first input value A is larger than the second input value B, the output signal c of the comparing circuit 110 is set to the high level. In the initial state, the output of the latch circuit 106 has the maximum value (high level), so that the output signal c is also set to the high level.

When the detection signal b from the comparator 101 rises, therefore, the signal d in FIG. 2 is generated from the AND 105 and operates as a latch clock of the latch circuit 106. Thus, the latch circuit 106 holds the count value of the counter 103 at a time point of the leading edge of the detection signal b, that is, a time point after the elapse of a time $t_1$ from the trailing edge of the horizontal sync signal h. Accordingly, the first input value A of the comparing circuit 110 is equal to or less than the second input value B, so that the output signal c of the comparing circuit 110 is set to the low level and the latch clock d of the latch circuit 106 is gated by the AND 105.

When the reset signal g of the counter 103 is supplied, the count value is reset, so that the first input value A of the comparing circuit 110 is larger than the second input value B and the output signal c of the comparing circuit 110 is again set to the high level. When the detection signal b from the comparator 101 again rises for a period of time when the counter 103 counts the clocks until the time $t_1$ after the reception of the reset signal g of the counter 103, the latch clock d is generated from the AND 105 and a new count value is held in the latch circuit 106. As mentioned above, information indicative of the earliest start position in a certain predetermined period in the start position of the video display period y in the video signal a (that is, the first leading position in the horizontal direction in the video signal a) is held in the latch circuit 106.

A portion of the embodiment comprising the latch circuit 107, comparing circuit 111, AND 109, and inverter 112 holds information indicative of the end position of the video display period y in the video signal a.

Such an operation is opposite to the operation mentioned above. Namely, the comparing circuit 111 receives the count value of the counter 103 as a first input value A and the output of the latch circuit 107 as a second input value B and executes the comparing operation. In a manner similar to the comparing circuit 110, when the first input value A is larger than the second input value B, the output signal e in FIG. 2 is set to the high level. Since the output of the latch circuit 107 has the minimum value (low level) in the initial state, the output signal e is also set to the high level.

The polarity of the detection signal b from the comparator 101 is inverted by the inverter 112 and the inverted signal is supplied to the AND 109. Therefore, when the detection signal b from the comparator 101 trails, the signal f in FIG. 2 is generated from the AND 109 and operates as a latch clock of the latch circuit 107.

Thus, the count value of the counter 103 at a time point of the trailing edge of the detection signal b, namely, a time point of the elapsed time $t_2$ from the trailing edge of the horizontal sync signal h is held in the latch circuit 107. Even if the count value is held, as the counting continues, the first input value A of the comparing circuit 111 becomes larger than the second input value B, so that the output signal e of the comparing circuit 111 is maintained to be high level and the latch clock f becomes a pulse-like waveform as shown in FIG. 2.

When the reset signal g of the counter 103 is subsequently supplied, the output signal e of the comparing circuit 111 is set to the low level until the time $t_2$ because the count value is smaller than the value held in the latch circuit 107. The output signal e is set to the high level after the time $t_2$ because the count value is larger than the value held in the latch circuit 107. When the detection signal b from the comparator 101 again trails after the time $t_2$, the count value at this time point is held in the latch circuit 107. As mentioned above, information indicative of the latest end position in a certain predetermined period in the end position of the video display period y in the video signal a (namely, the last trailing position in the horizontal direction in the video signal a) is held in the latch circuit 107.

The latch circuit 108 holds the count value for one horizontal period by using the horizontal sync signal h as a latch clock, and generates horizontal period information.

The CPU 114 receives various information regarding with the video signal a, obtained as mentioned above, and calculates a ratio Y X of the video display period y and a ratio of a front porch period x in one horizontal period on the basis of that information in accordance with the following formulas (1) and (2):

(1) Ratio Y=video display period y/one horizontal scanning period; and (2) Ratio X=front porch period x/one horizontal scanning period. After that, control information of the horizontal display size is formed by an arithmetic operation from the ratio of the video display period y in one horizontal period. Control information of the horizontal display position is formed by an arithmetic operation from the ratio of the front porch period x in one horizontal period. An operation clock signal j of the CPU 114 is formed by the clock generating circuit 113 and is obtained by frequency dividing a clock signal i into 1/N frequency (N is a natural number).

The control information of the horizontal display size and horizontal display position formed by the CPU 114 are supplied to the DAC 116. The DAC 116 converts the control information into the control voltages or current as the control signals of a horizontal deflection circuit (similar to the prior art horizontal deflection circuit shown in FIG. 12) of the multi-scan display, thereby controlling the display size and display position of the video image on the screen. The control voltage of a display size controls the raster size of the deflection circuit to adjust the video display size. Similarly, the control voltage of the display position controls the phase of the synchronizing signal input to the deflection circuit to adjust the display position of the video display image. Although the DAC 116 of the multi-output type is shown in FIG. 1, a plurality of DACs of the single output type can be also obviously used. The DAC 116 is controlled by the CPU 114.

Further, the control information of the horizontal display size and horizontal display position formed by the CPU 114 are also written into the writable read only memory (non-volatile memory) 115. The memory 115 is also controlled by the CPU 114.

With the above construction, the video image can be displayed at the display size and display position of the video image suitable for the display timings of various kinds of video signals which are supplied to the multiscan display. Moreover, the adjustment is automatically performed without touching the multiscan display by the hand of the user.

Figure 3:
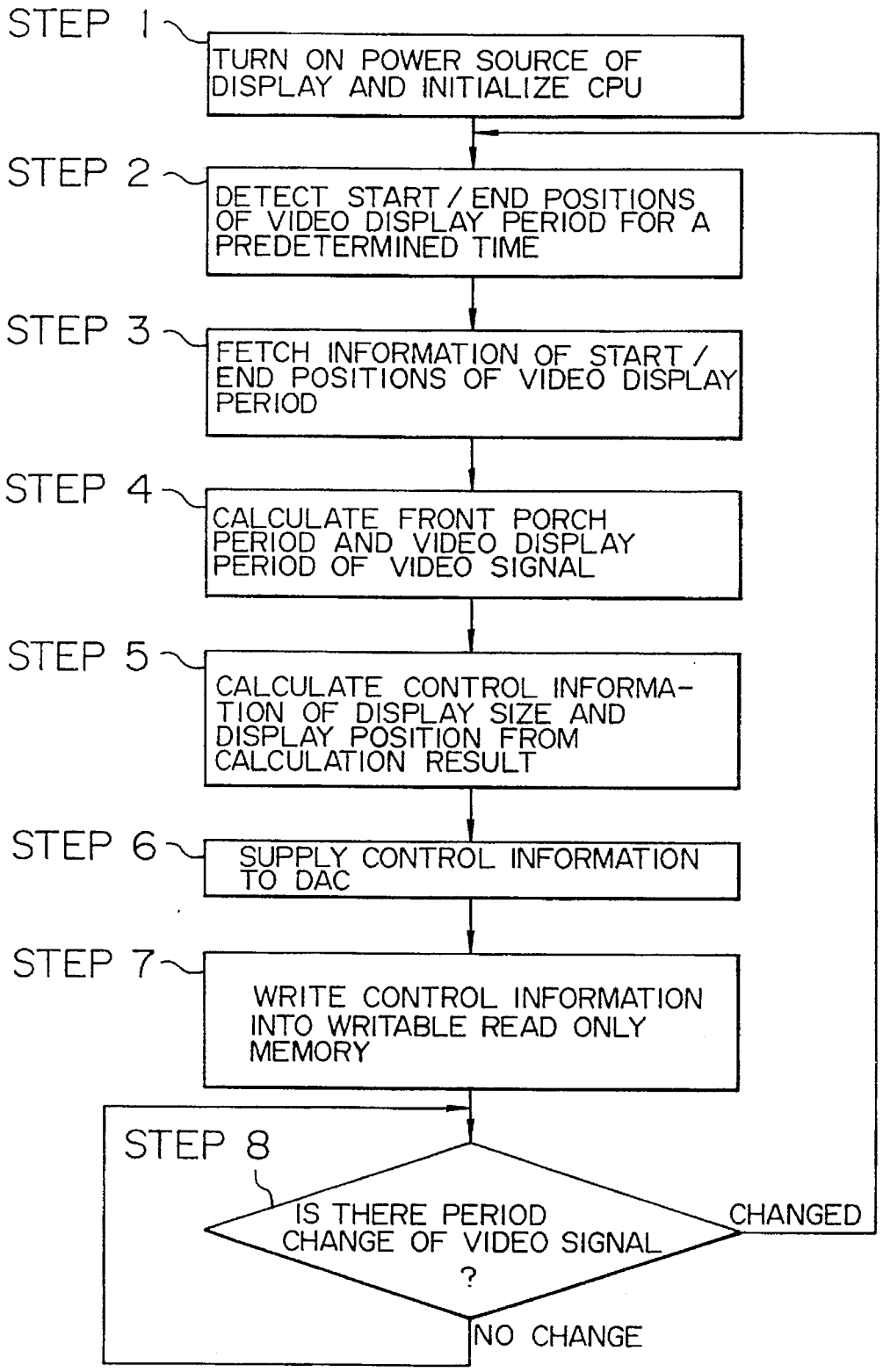
FIG. 3 is a flowchart showing a flow of the operation of a CPU in FIG. 1.

FIG. 3 is a flowchart showing a flow of the operation of the CPU 114 in FIG. 1. A processing routine of FIG. 3 will now be described hereinbelow.

In the first step 1, when a power source of the multiscan display main body is turned on, the CPU 114 in FIG. 1 is initialized and the programs stored in the read only memory (not shown although it is a memory attached to an ordinary CPU) in the CPU 114 are sequentially executed. In step 2, the apparatus waits for the execution of the next process until a predetermined time during which the information of the start position and end position of the video display period y, which are held in the latch circuits 106 and 107 in FIG. 1, is specified. A specifying condition in this instance is set such that the above information is fetched at predetermined intervals and when the fetched values coincide with the preceding values, it is regarded that the information has been specified. Further, when the elapsed time exceeds the predetermined time, it is regarded that the information has been specified at that time point.

In step 3, after the CPU 114 judged that the information has been specified, the information of the start position and end position of the video display period y and the horizontal period information are fetched. In step 4, the ratio of the video display period y in one horizontal period and the ratio of the front porch period x in one horizontal period are calculated from this information.

In step 5, control information Of the horizontal display size is formed by an arithmetic operation from the ratio of the video display period y in one horizontal period, and also information of the horizontal display position is formed by an arithmetic operation from the ratio of the front porch period x in one horizontal blanking period. For instance, as an operating method, the arithmetic operations are executed in a manner such that when the ratio of the video display period y is equal to 90%, the control information of the horizontal display size corresponds to the maximum horizontal display size, and when it is equal to 60%, the control information of the horizontal display size corresponds to the minimum horizontal display size, and when it lies within a range from 60% to 90% (however, for any video signal, the ratio of the display period of the video signal lies within the range of 60% to 90%), the control information corresponds to a horizontal display size according to the proportional distribution in which the CPU 114 executes the arithmetic operations in accordance with the ratio of the video display period in one horizontal period to make the control information of the horizontal display size. Similarly, the arithmetic operations are executed in a manner such that when the ratio of the front porch period x is equal to 10%, the control information is set to the minimum horizontal display position (in the state wherein the displayed video image is displayed at the left-most side of the picture), and when it is equal to 40%, the control information is set to the maximum horizontal display position (in the state wherein the displayed video image is displayed at the right-most side of the picture), and when it lies within a range from 10% to 40%, the control information is set to the horizontal display position according to the proportional distribution.

As described above, when the maximum value and the minimum value of the control information are previously set corresponding to the maximum value and the minimum value of the ratio of the video display period and the ratio of the front porch period, even if the above-mentioned ratios lie within a range from the minimum value to the maximum value, the control information is computed and produced by the CPU 114. In other words, the above-mentioned computing is based on the proportional distribution and the control information for controlling the horizontal display size and the displayed position of the displayed picture can be produced by this computing.

In step 6, the respective control information obtained in step 5 by the CPU 114 is supplied to the DAC 116 in FIG. 1 and converted into a DC control voltage as the control signal of the horizontal display size or horizontal display position. The control voltage of a display size controls the raster size of the deflection circuit to adjust the video display size. Similarly, the control voltage of the display position controls the phase of the synchronizing signal input to the deflection circuit to adjust the display position of the video display image. As described above, since a dc voltage is used for controlling the deflection circuit of the multi-scan display, it is possible to use the generally used former deflection circuit. The method of controlling the deflection circuit by the control signal is performed similarly as the former embodiment shown in FIG. 12. In step 7, the control information obtained in step 5 is written into the writable read only memory 115 in FIG. 1. In step 8, the horizontal period information of the video signal a is monitored and the presence or absence of the change is checked. When there is no change, the process in step 8 is repeated. When it is determined that there is a change, the processing routine is returned to step 2.

By the above processes, the horizontal display size and horizontal display position can be automatically adjusted.

Figure 4:
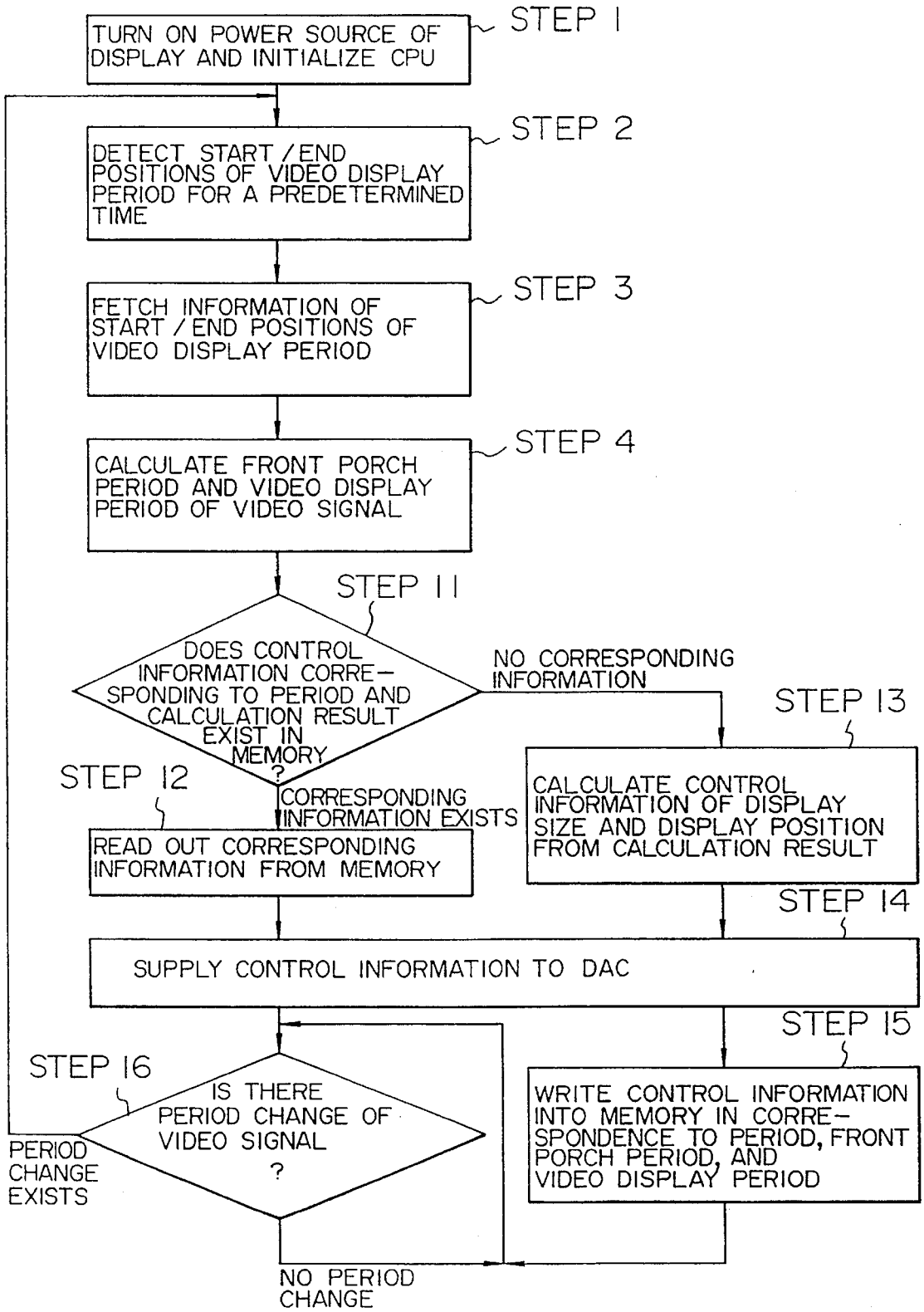
FIG. 4 is a flowchart showing a flow of another operation of the CPU in FIG. 1.

FIG. 4 is a flowchart showing a flow of another operation of the CPU 114 in FIG. 1.

In FIG. 4, the processes in steps 1 to 4 are similar to those of the same step numbers in FIG. 3. In step 11, a check is made to see if the control information of the horizontal display size and horizontal display position corresponding to the horizontal period information generated from the latch circuit 108 and to the information indicative of the ratios of the video display period y and front porch period x in one horizontal period calculated in step 4 exist in the information stored in the read only memory 115 or not. When the corresponding control information exists, it is read out in step 12 and supplied to the DAC 116 in the next step 14.

In the next step 16, the horizontal period information generated from the latch circuit 108 is monitored, thereby checking the presence or absence of the change. When there is no change, the process in step 16 is repeated. When there is a change, the processing routine is returned to step 2.

On the other hand, when the corresponding control information does not exist in step 11, in step 13, control information of the horizontal display size and horizontal display position are formed by an entirely similar technique as used in step 5 in FIG. 3 on the basis of the information indicative of the ratios of the video display period y in one horizontal period and front porch period x in a horizontal blanking period which have been calculated in step 4. Then, in step 14, similarly as in step 6 in FIG. 3, the horizontal display size and the horizontal display position are adjusted.

In step 15, the control information of the horizontal display size and horizontal display position formed in step 13 are written into the read only memory 115 together with the horizontal period information generated from the latch circuit 108 and the information indicative of the ratios of the video display period y and front porch period x in one horizontal period which have been calculated in step 4. Step 16 then follows.

By the above processes, when the power source of the multiscan display rises at the next time, on the basis of the horizontal period information generated from the latch circuit 108 and the information indicative of the ratios of the video display period y and front porch period x in one horizontal period which have been calculated, the control information of the horizontal display size and horizontal display position corresponding to them are read out from the read only memory 115. Therefore, the calculating time by the formation of the control information can be omitted.

Figure 5:
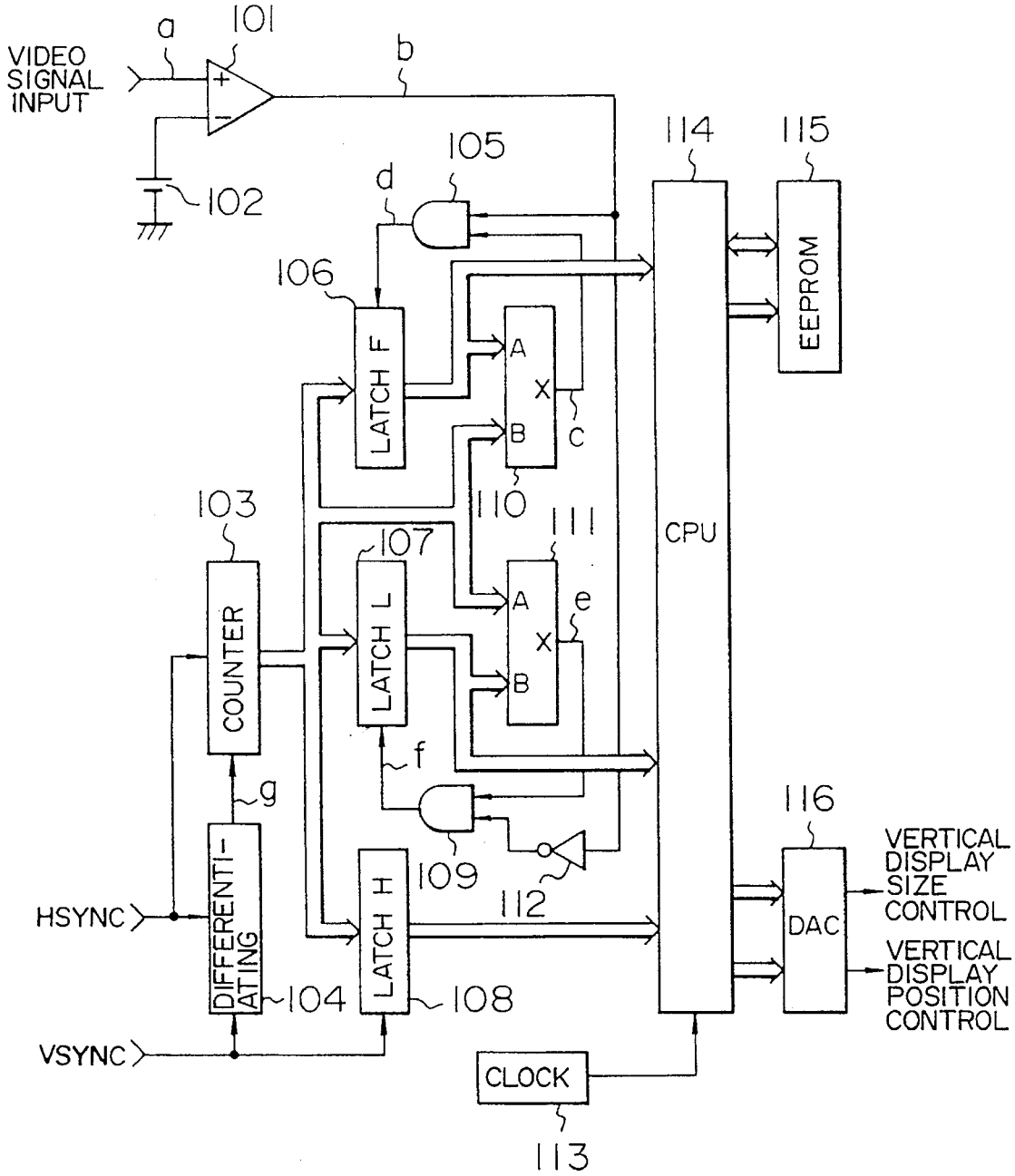
FIG. 5 is a block diagram showing the second embodiment of the invention.

FIG. 5 is a block diagram showing the second embodiment of the invention.

In FIG. 5, the same parts and components having the same functions as those in FIG. 1 are designated by the same reference numerals.

The operation of the embodiment is similar to that of the embodiment of FIG. 1 except for the following different points. That is, according to the embodiment, as shown in FIG. 5, in order to obtain the ratios of the video display period and front porch period in one vertical period of the video signal, a vertical sync signal is supplied as an input signal of the differentiating circuit 104 and a horizontal sync signal is supplied as clock inputs of the differentiating circuit 104 and counter 103, respectively. The counter 103 counts the number of horizontal sync signals in one vertical period.

The latch circuit 108 holds the count value for one vertical period by using the vertical sync signal as a latch clock and generates vertical period information. Information indicative of the start position and end position of the video display period in the vertical direction in the video signal a is held in the other latch circuits 106 and 107, respectively, in a manner similar to FIG. 1. On the basis of that information, the CPU 114 forms the control information of the vertical display size and vertical display position and converts them into the control voltages by the DAC 116.

With the above construction, the adjustment in the vertical direction can also be automatically performed.

Figure 6:
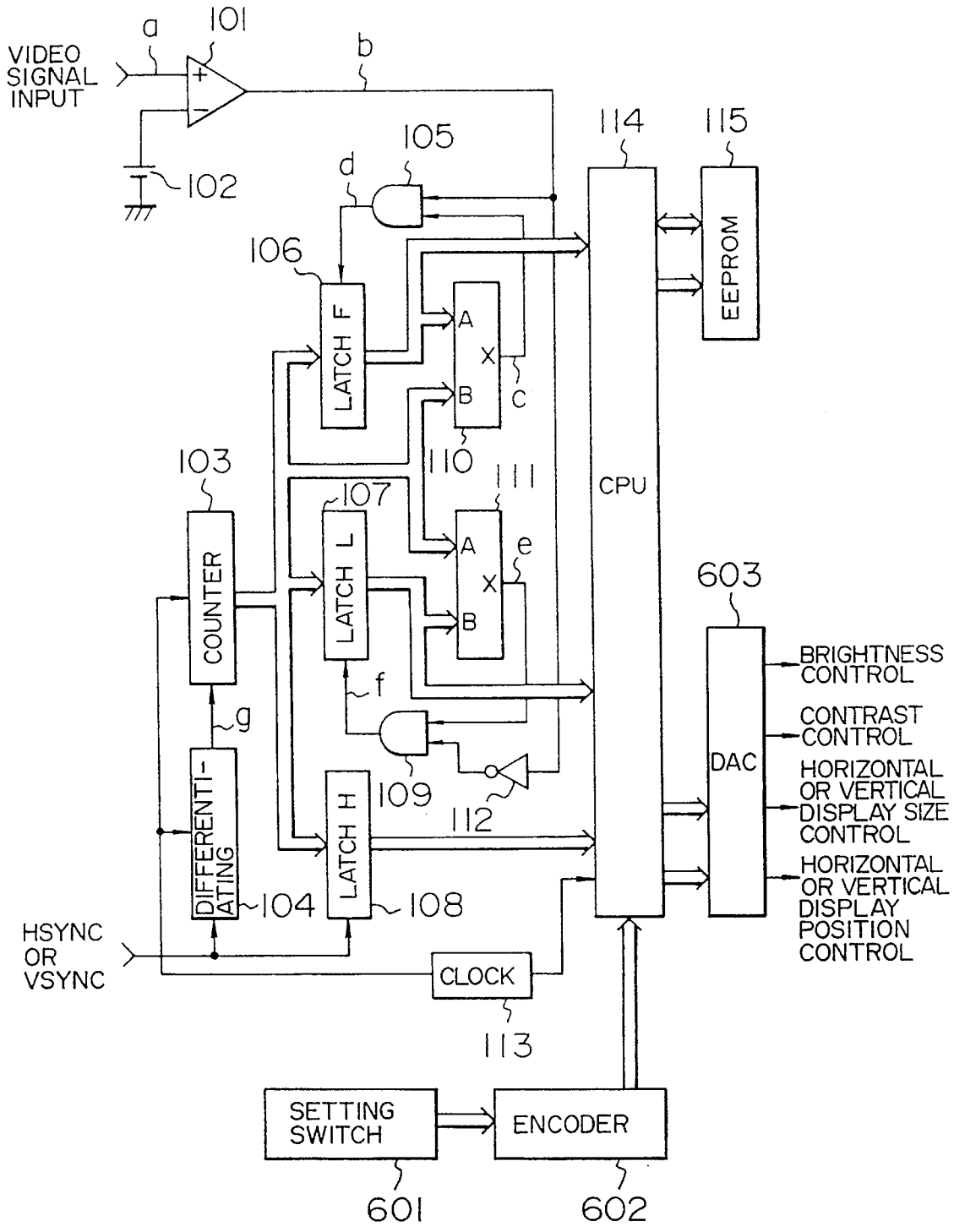
FIG. 6 is a block diagram showing the third embodiment of the invention.

FIG. 6 is a block diagram showing the third embodiment of the invention.

In FIG. 6, the parts and components having the same functions as those in FIG. 1 are designated by the same reference numerals. Further, reference numeral 601 denotes a manual setting switch; 602 an encoder; and 603 a digital/analog converting circuit (hereinafter, referred to a DAC) of the 4-output type. The operation of FIG. 6 will now be described hereinbelow.

As mentioned in FIG. 1 or 6, on the basis of the information indicative of the ratios of the video display period and front porch period in one horizontal or vertical period which have been calculated, the CPU 114 forms control information of the display size and display position of the video image by arithmetic operations and also forms control information of the brightness and contrast of the display image by arithmetic operations.

Figure 12:
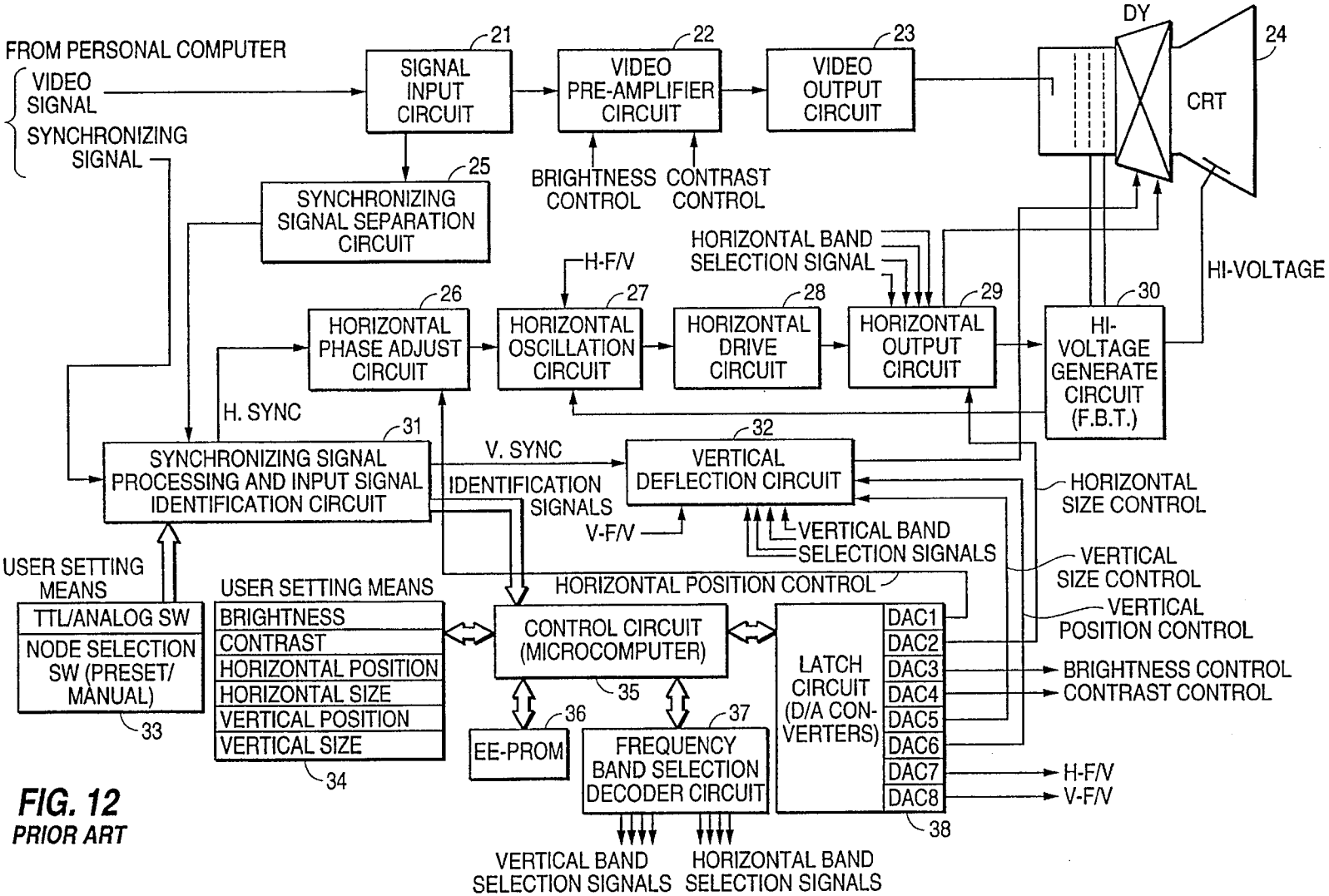
FIG. 12 PRIOR ART
FIG. 12 is a block diagram showing a former multi-scan display device.

The control information of the display size and display position and the control information of the brightness and contrast of the display video image which have been formed by the CPU 114 are supplied to the DAC 116 and are sent to a horizontal deflecting circuit similar to the prior art horizontal deflection circuit shown in FIG. 12 and the like of the multiscan display as a control voltage of the display size or display position and a control voltage of the brightness or contrast, thereby controlling the display size or display position of the screen and the brightness or contrast of the display video image.

The manual setting switch 601 includes: selecting switches to select the horizontal and vertical display size and display position and, further, the adjustments of the brightness and contrast of the display video image; a data up/down switch to set adjustment amounts; a data entry switch to register the set values, and the like. The manual adjustment is executed by those switches.

Data set by the manual setting switch 601 is properly encoded by the encoder 602 so as to be easily supplied to the CPU 114. The CPU 114 receives the encoded data from the encoder 602 and increases or decreases the set control information in the control information formed in the CPU 114.

All of the control information is also written into the read only memory 115 and used as information for automatic adjustment from the next time.

As mentioned above, according to the embodiment, in addition to the automatic adjusting function of the display size and display position of the screen, the automatic adjusting function of the brightness and contrast of the display video image is provided. Further, the video image can be displayed at desired size and position and brightness or contrast by the manual adjusting function, so that the using efficiency and convenience can be improved.

Figure 7:
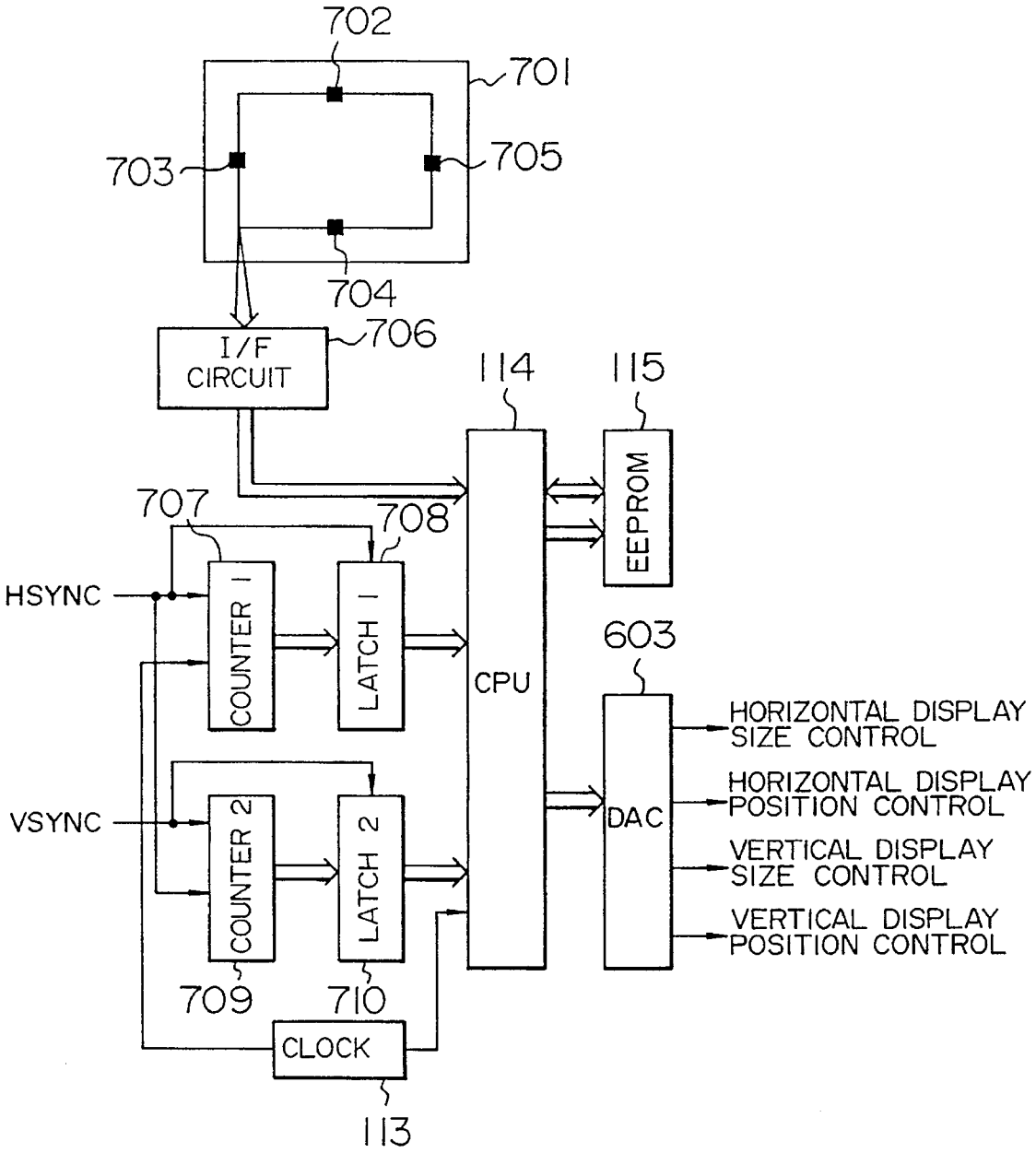
FIG. 7 is a block diagram showing the fourth embodiment of the invention.

FIG. 7 is a block diagram showing the fourth embodiment of the invention. The fourth embodiment will now be described hereinbelow.

In FIG. 7, the parts and components having the same functions as those in FIGS. 1 and 6 are designated by the same reference numerals. Further, reference numeral 701 denotes a panel which is attached to the front surface of the screen of the multiscan display; 702, 703, 704, and 705 photo sensitive devices; 706 an interface circuit; 707 and 709 counters; and 708 and 710 latch circuits. The operation of FIG. 7 is as follows.

The panel 701 is a detachable transparent panel which is attached onto the display screen. The photo sensitive devices 702, 703, 704, and 705, such as photo transistors, are attached to the upper, left, lower, and right positions of the panel. The attaching positions of the photo sensitive devices 702, 703, 704, and 705 are arranged on the outer periphery such that the video image is displayed on the display screen at the optimum display size and display position.

Each of the photo sensitive devices 702 to 705 detects the light emission of the display tube at the attaching position of the panel 701 and converts the detected light emission into the electric signal. Each of the photo sensitive devices 702 to 705 is connected by a transparent electrode. The converted electric signal is supplied to the interface circuit 706 and encoded into the video detection signal according to the input level of the CPU 114.

The CPU 114 judges which portion on the display screen is lighted from the video detection signal. On the basis of the result of the judgment, the CPU 114 forms control information of the horizontal or vertical display size and display position by arithmetic operations, respectively, and supplies the control information to the DAC 603. An arithmetic operating method of the CPU 114 will be explained in detail hereinlater.

When the display size and display position of the video image which is displayed on the screen of the multiscan display are properly set by the control voltages from the DAC 603, the CPU 114 receives the horizontal period information which is obtained by the counter 707 and latch circuit, and the vertical period information which is derived by the counter 709 and latch circuit 710, and writes into the writable read only memory 115 as information of the video signal which is at present being adjusted together with the control information of the display size and display position mentioned above.

As mentioned above, the written control information is read out in the case where the period of the sync signal which is supplied to the multiscan display main body coincides with the period written in the read only memory 115 when the power source of the multiscan display is turned on at the next time, thereby making the arithmetic operations for the foregoing initial adjustment unnecessary.

An arithmetic operating method of forming the control information by the CPU 114 will now be de-scribed.

Figure 8:
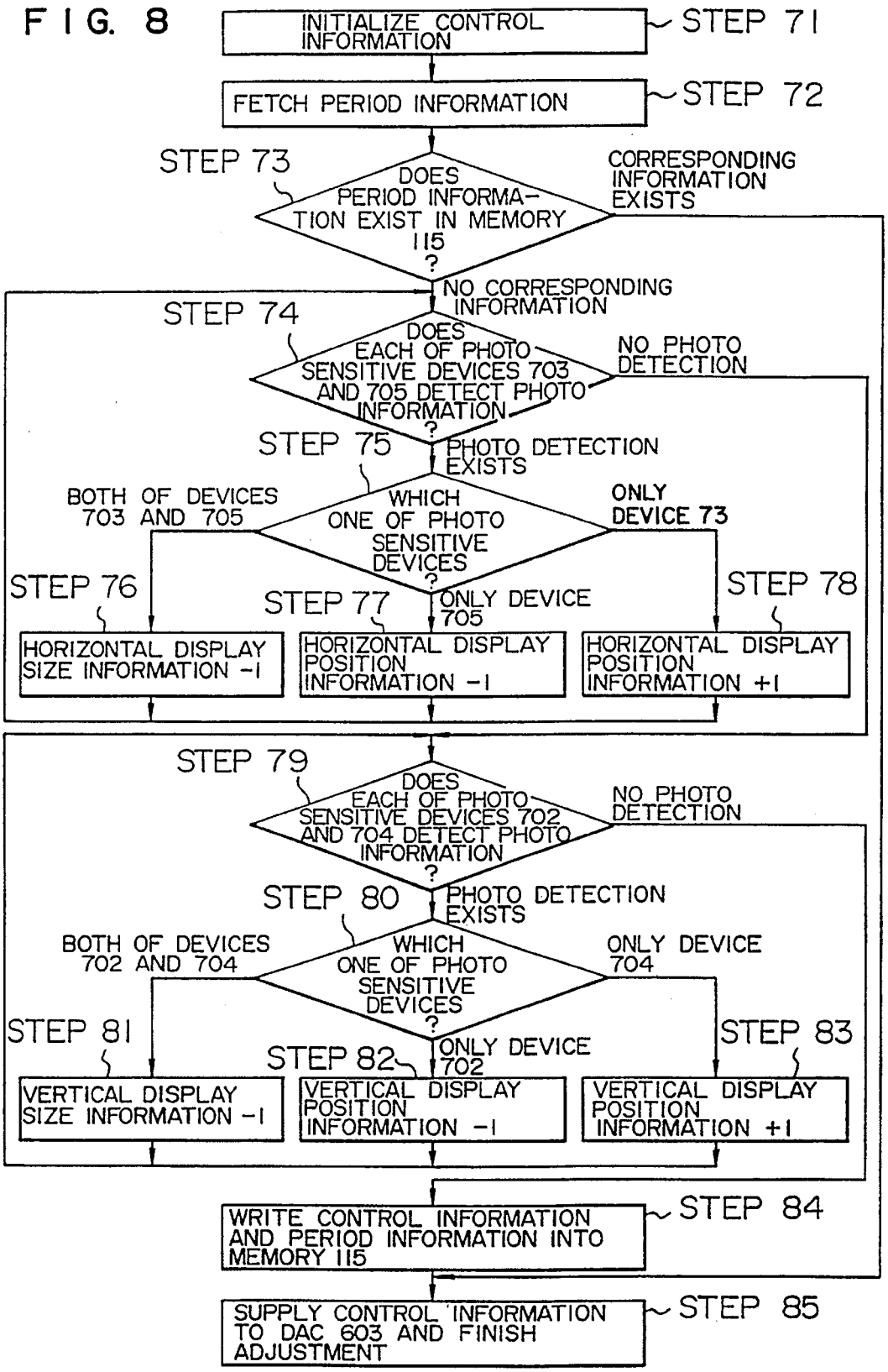
FIG. 8 is a flowchart showing a flow of the operation of a CPU in FIG. 7.
Figure 9:
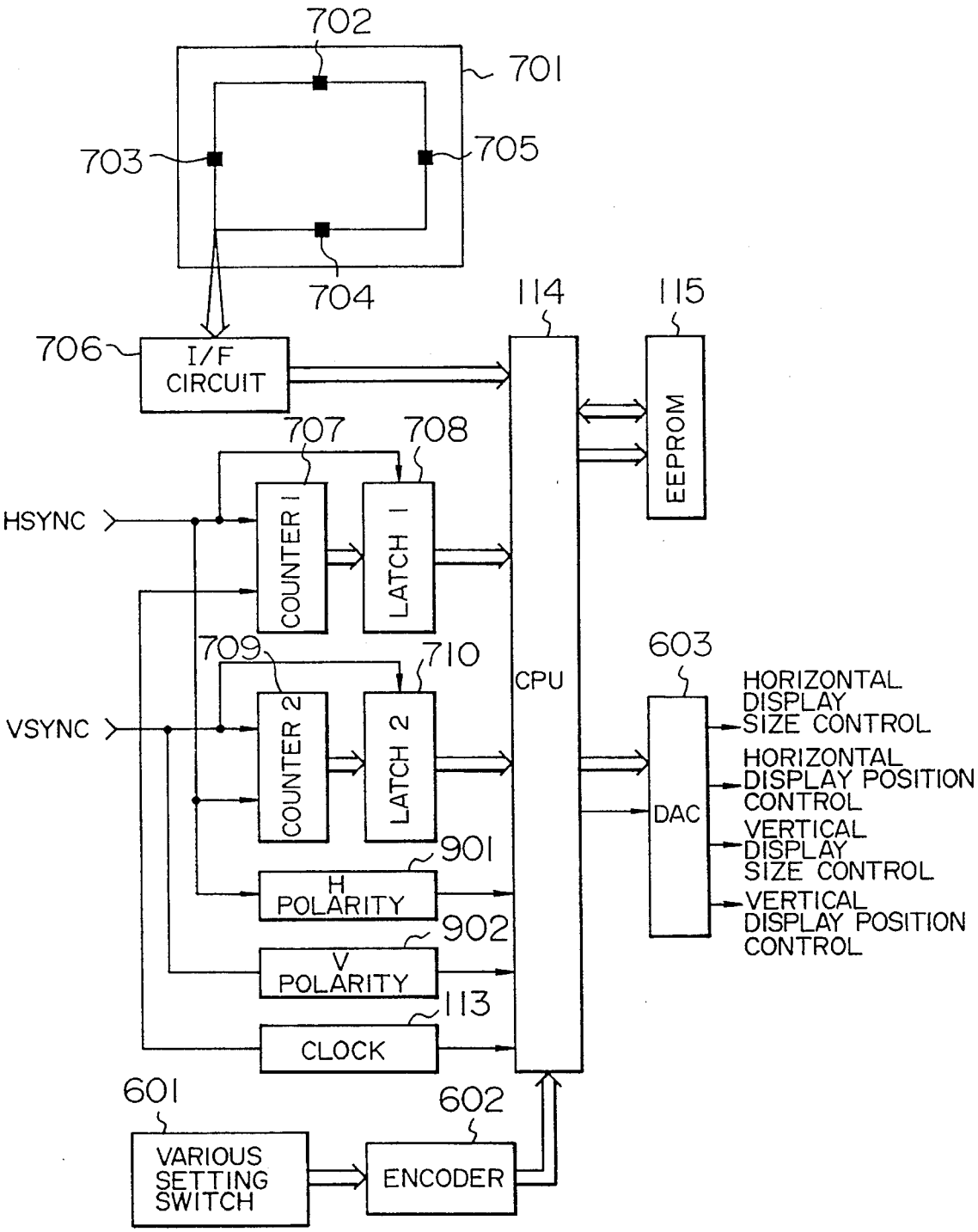

FIG. 8 is a flowchart showing a flow of the operation of the CPU 114 in FIG. 7.

As shown in FIG. 8, in the first step 71, when the power source of the multiscan display is turned on, the initial values of the control information of the display size and display position are read out from the read only memory 115 or a memory provided in the CPU 114 and are supplied to the DAC 603. The maximum value is read out as an initial value of the display size and the center value is read out as an initial value of the display position.

In the next step 72, the period information of the video signal which is supplied to the multiscan display is fetched. In step 73, a check is made to see if the control information of the display size and display position corresponding to the period information fetched in step 72 exists in the information stored in the read only memory 115 or not. When the corresponding control information exists, step 85 follows. When the corresponding control information does not exist, step 74 follows.

In step 74, a check is first made to see if each of the photo sensitive devices 703 and 705 has detected a predetermined luminance at a predetermined position on the display screen of the multiscan display or not. If YES, step 75 follows. If NO, step 79 follows. In step 75, a check is made to see which one of the photo sensitive devices has detected the predetermined luminance. When both of the photo sensitive devices 703 and 705 have detected the luminances, step 76 follows. When only the photo sensitive device 705 has detected the luminance, step 77 follows. When only the photo sensitive device 703 has detected the luminance, step 78 follows.

In step 76, a process to subtract "1" from the information of the horizontal display size of the video image that is at present being displayed is executed, thereby reducing the display size. In step 77, a process to subtract "1" from the information of the horizontal display position of the video image that is at present being displayed is executed, thereby shifting the display position to the left. In step 78, a process to add "1" to the information of the horizontal display position is executed on the contrary to step 77, thereby shifting the display position to the right.

After completion of the process in any of steps 76, 77, or 78, new control information is supplied to the DAC 603 and the processing routine is returned to step 74.

When the processing routine advances from step 74 to step 79, a check is made to see if each of the photo sensitive devices 702 and 704 has detected a predetermined luminance or not. If YES, step 80 follows. If NO, step 84 follows. In step 80, a check is made to see which one of the photo sensitive devices 702 and 704 has detected the predetermined luminance in a manner similar to the process in step 75. When both of the photo sensitive devices have detected the luminances, step 81 follows. When only the photo sensitive device 702 has detected the luminance, step 82 follows. When only the photo sensitive device 704 has detected the luminance, step 83 follows.

In step 81, "1" is subtracted from the information of the current vertical display size, thereby reducing the display size. In step 82, "1" is subtracted from the information of the vertical display position, thereby shifting the display position downward. In step 83, "1" is added to the information of the vertical display position, thereby shifting the display position upward.

After completion of the process in step 81, 82, or 83, new control information is supplied to the DAC 603 and the processing routine is returned to step 79.

When it is determined in step 79 that no luminance is detected, step 84 follows. In step 84, the control information after completion of each of the above processes is written into the read only memory 115 together with the period information fetched in step 72. After that information is written into the memory, step 85 follows. In step 85, the control information is supplied to the DAC 603 and the adjustments of the display size and display position are finished.

By the above processes, the display state of the video image on the screen can be optimized to the display size and display position surrounded by the photo sensitive devices 702 to 705.

FIG. 9 is a block diagram showing the fifth embodiment of the invention.

In FIG. 9, the parts and components having the same functions as those in FIG. 1, 6, or 7 are designated by the same reference numerals. Further, reference numeral 901 denotes a polarity detecting circuit of the horizontal sync signal and 902 indicates a polarity detecting circuit of the vertical sync signal.

The fifth embodiment is constructed by adding the polarity detecting function of the sync signals and the manual adjusting function for enabling the display size, display position, and the like to be also manually adjusted to the construction of the embodiment of FIG. 7.

The polarity detecting circuits 901 and 902 of the horizontal and vertical sync signals detect the polarities of the horizontal and vertical sync signals and, for instance, generate high level signals in case of the sync signals having the positive polarity and low level signals in case of the sync signals having the negative polarity. Those polarity detection signals are supplied to the CPU 114 and used as video signal information together with the period information obtained from the latch circuits 708 and 710.

Consequently, the control information of the display size and display position when the same video signal is supplied can be more certainly read out. On the other hand, since the user can freely set the display size and display position, the using efficiency and convenience can be further improved.

In the conventional method, the blanking signal which is used in the multiscan display is constant irrespective of the input video signal and is unconditionally determined by the circuit constant, so that there is a problem such that a flyback line is seen on the screen in dependence on the input video signal or the like. The following embodiment, therefore, is considered as an embodiment which can solve such a problem.

Figure 10:
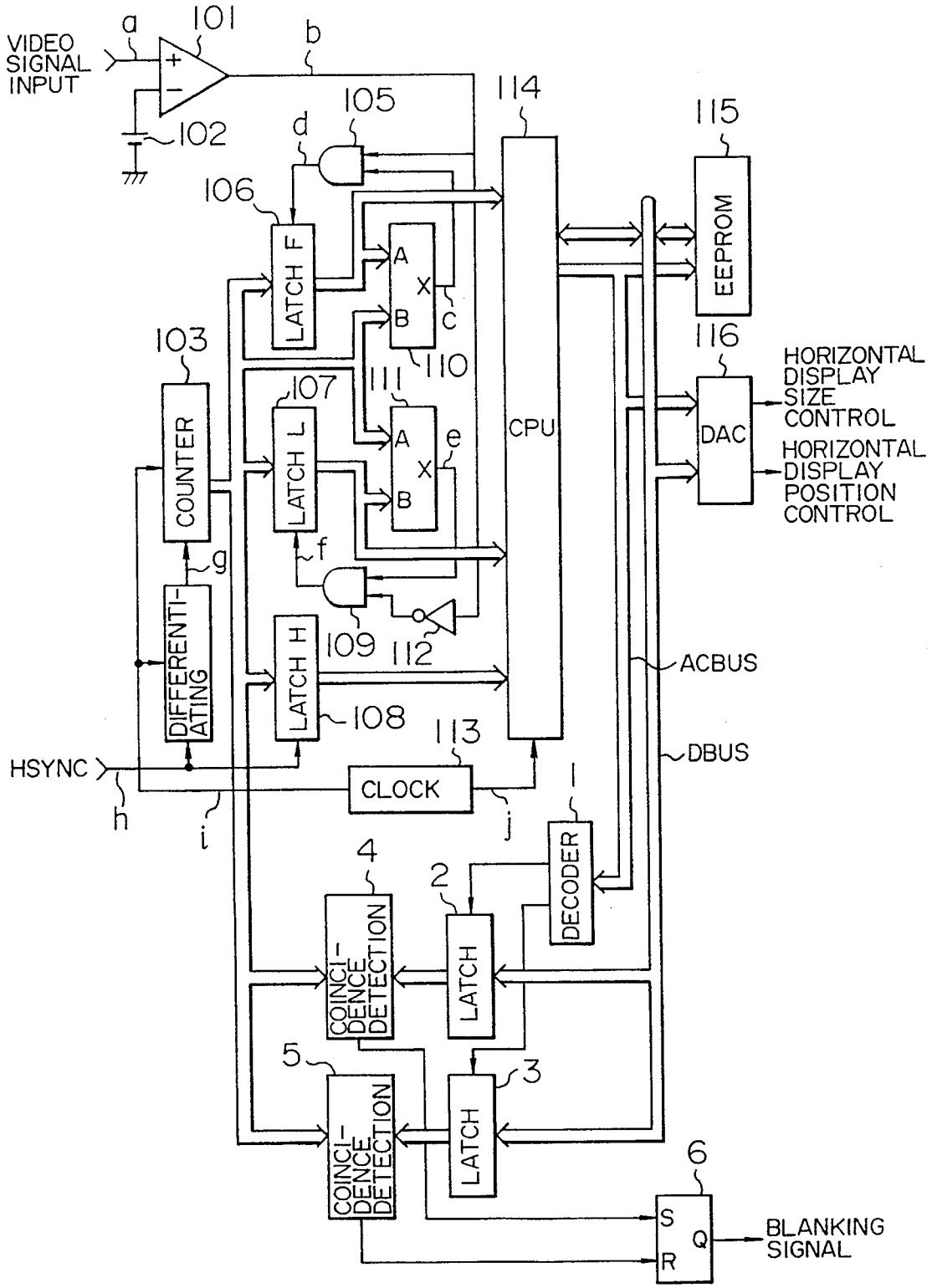
FIG. 10 is a block diagram showing the sixth embodiment of the invention.

FIG. 10 is a block diagram showing the sixth embodiment of the invention.

In FIG. 10, the parts and components having the same functions as those in FIG. 1 are designated by the same reference numerals. Further, reference numeral 1 denotes a decoder; 2 and 3 latch circuits; 4 and 5 coincidence detecting circuits; 6 a set-reset flip-flop circuit (hereinafter, referred to an FF circuit); ACBUS an address/control bus which is led out from the CPU 114; and DBUS a data bus. The operation of FIG. 10 will now be described hereinbelow.

In FIG. 10, on the basis of the control information of the display size and display position which have been formed, the CPU 114 forms information of the start position and end position of the blanking period of the video signal a that is supplied to the multiscan display by arithmetic operations. The information of the start position of the blanking period is sent to the latch circuit 2 through the data bus DBUS. In this instance, an address signal corresponding to the information of the display position and a control signal similar to the signal which is generally generated from the CPU are generated from the CPU 114 to the bus ACBUS. The decoder 1 discriminates the address signal and generates a latch clock to the latch circuit 2. As mentioned above, the information of the start position of the blanking period is held in the latch circuit 2.

In substantially the same manner as above, when the information of the end position of the blanking period is sent to the DBUS, an address signal corresponding to such information is sent to the bus ACBUS. The decoder 1 discriminates the address signal and generates the latch clock to the latch circuit 3. The information of the end position of the blanking period is held in the latch circuit 3.

Outputs of the latch circuits 2 and 3 are supplied to the coincidence detecting circuits 4 and 5 and compared with the count value of the counter 103. In this instance, when both input values of the coincidence detecting circuit 4 coincide, the detecting circuit 4 generates a pulse to a set input terminal of the FF circuit 6. Thus, the FF circuit 6 starts to generate the blanking signal.

When both inputs of the coincidence detecting circuit 5 coincide, the circuit 5 generates a pulse to a reset input terminal of the FF circuit 6, thereby finishing the generation of the blanking signal of the FF circuit 6. As mentioned above, the blanking signal corresponding to the input video signal a is always derived from the FF circuit 6.

The above description relates to the case where the invention is applied to the embodiment of FIG. 1. The invention can be also similarly applied to each of the embodiments of FIGS. 5, 6, 7, and 9.

Figure 11:
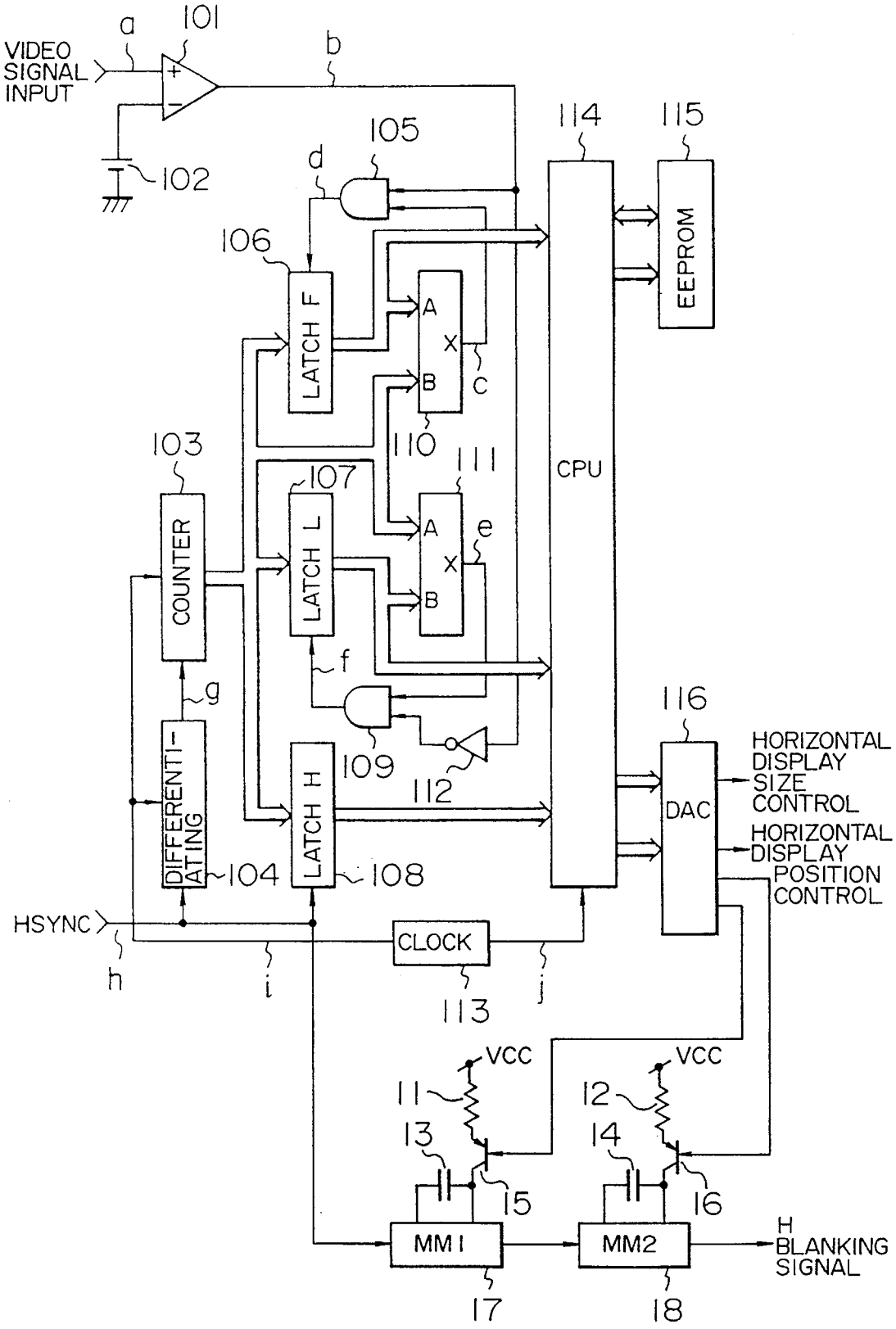
FIG. 11 is a block diagram showing the seventh embodiment of the invention.

FIG. 11 is a block diagram showing the seventh embodiment of the invention. The seventh embodiment can obtain an effect similar to that in the embodiment of FIG. 10.

In FIG. 11, the parts and components having the same functions as those shown in FIG. 1 or 6 are designated by the same reference numerals. Further, reference numerals 11 and 12 denote resistors; 13 and 14 capacitors; 15 and 16 transistors; and 17 and 18 monostable multivibrators (hereinafter, referred to MM circuits). The operation of FIG. 11 will now be described hereinbelow.

In FIG. 11, on the basis of the control information of the display size and display position which have been formed, the CPU 114 forms information of the start position of the blanking period of the video signal a and information of the blanking period by arithmetic operations. The formed information are respectively converted into the control voltage of the start position of the blanking period and the control voltage of the blanking period by the DAC 603.

The control voltage of the start position of the blanking period is supplied to a base electrode of the transistor 15 and controls a time constant setting portion of the MM circuit 17 comprising the resistor 11, transistor 15, and capacitor 13. The MM circuit 17 generates a pulse corresponding to the start position of the blanking period of the video signal a after the elapse of a predetermined delay time from the trailing or leading edge of the input horizontal sync signal in accordance with the set time constant.

The control voltage of the blanking period is supplied to a base electrode of the transistor 16 and controls a time constant setting portion of the MM circuit 18 comprising the resistor 12, transistor 16, and capacitor 14. The MM circuit 18 sets a width of a predetermined period in accordance with the set time constant for the output pulse of the MM circuit 17 and generates a blanking signal. As mentioned above, the blanking signal corresponding to the input video signal a is derived from the MM circuit 18.

The blanking signal forming portion in the embodiment is also effective to each of the embodiments of FIGS. 5, 6, 7, and 9 and a similar effect is also obtained.

According to the invention, the display size and display position which are adapted to the display timing of the video signal that is supplied to the multiscan display can be automatically controlled. Therefore, the adjusting apparatus and adjusting time to execute the writing of the information (initial set data) of the display position and display size into the memory which is executed every multiscan display are unnecessary. The setting step at a factory can be omitted and a productivity can be improved. Even in the case where the video signal having the same sync signal frequency but the different display timing of the video image has been supplied, the optimum video display can be obtained. Even when an unknown video signal has been supplied, the adjustment can be automatically performed, so that a troublesomeness of the manual adjustment or the like by the user is also eliminated and the using efficiency and convenience can be further improved.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

We claim:

1. An automatic adjusting apparatus of a multi-scan display which receives at least a video signal and displays a video image according to said video signal on a screen, said apparatus comprising:

detecting means for detecting a scanning period of said video signal, a display start position and a display end position;

arithmetic operation control means for calculating a ratio Y of a video display period over one of a horizontal scanning period and/or a vertical scanning period and a ratio X of a front porch period over one of a horizontal scanning period and/or a vertical scanning period based on information output from said detecting means and for generating control information to set said video image displayed on the screen to a predetermined display size and/or a predetermined display position based only on the calculated ratios; and converting means for converting said control information supplied from said arithmetic operation control means to a control voltage or current, and for outputting said control voltage or current to a deflection circuit as a control signal of the deflection circuit of said multi-scan display.

2. An apparatus according to claim 1, further comprising holding means for holding control information as an output of said arithmetic operation control means, and wherein when control information corresponding to said video signal exists in said holding means, said arithmetic operation control means does not execute the calculation of the ratios X and Y and generation of the control information but reads out the control information to be stored into said holding means, and therefore only when the corresponding control information does not exist in said holding means does said arithmetic operation control means execute the calculation of the ratios X and Y and generation of the control information and, further, writing of new control information into said holding means.

3. An apparatus according to claim 2, further comprising manual adjusting means for supplying manual adjustment information of the display size and display position of the video image to said arithmetic operation control means, and wherein when said manual adjustment information is supplied to said arithmetic operation control means, priority is given to said manual adjustment information and the control information regarding the video image of said display is formed.

4. An apparatus according to claim 3, further comprising blanking signal generating means of said video signal for generating a blanking signal, and wherein on the basis of the control information generated by said arithmetic operation control means, said arithmetic operation control means controls said blanking signal generating means so as to generate a blanking signal in an optimum state.

5. An apparatus according to claim 2, wherein said arithmetic operation control means produces control information regarding contrast and brightness of the video image displayed on the screen based on the display timing information extracted from said video signal, to enable automatic adjustment of the brightness and the contrast of said video image in accordance with said control information regardless of what kind of video signal is input to said display.

6. An apparatus according to claim 2, further comprising blanking signal generating means of said video signal for generating a blanking signal, and wherein on the basis of the control information generated by said arithmetic operation control means, said arithmetic operation control means controls said blanking signal generating means so as to generate a blanking signal in an optimum state.

7. An apparatus according to claim 2, wherein in said holding means, said video signal and the control information which is stored into said holding means are made correspond to each other by the result of the period detection of the video signal of said display timing detecting means and, further, by an output of polarity detecting means of a sync signal associated with the video signal.

8. An apparatus according to claim 7, wherein said arithmetic operation control means produces control information relating to the contrast and brightness of the video image displayed on the screen based on the display timing information extracted from said video signal, to enable automatic adjustment of the brightness and the contrast of said video image in accordance with said control information regardless of what kind of video signal is input to said display.

9. An apparatus according to claim 7, further comprising blanking signal generating means of said video signal for generating a blanking signal, and wherein on the basis of the control information generated by said arithmetic operation control means, said arithmetic operation control means controls said blanking signal generating means so as to generate a blanking signal in an optimum state.

10. An apparatus according to claim 1, further comprising manual adjusting means for supplying manual adjustment information of the display size and display position of the video image to said arithmetic operation control means, and wherein when said manual adjustment information is supplied to said arithmetic operation control means, priority is given to said manual adjustment information and the control information regarding the video image of said display is formed.

11. An apparatus according to claim 8, further comprising blanking signal generating means of said video signal for generating a blanking signal, and wherein on the basis of the control information generated by said arithmetic operation control means, said arithmetic operation control means controls said blanking signal generating means so as to generate a blanking signal in an optimum state.

12. An apparatus according to claim 10, wherein on the basis of display timing information extracted from said video signal, said arithmetic operation control means also forms control information regarding the video signals, including contrast, brightness, and the like of said video signal that is displayed on the screen.

13. An apparatus according to claim 1, wherein on the basis of display timing information extracted from said video signal, said arithmetic operation control means also forms control information regarding said video signal, including contrast, brightness, and the like of said video signal that is displayed on the screen.

14. An apparatus according to claim 13, further comprising blanking signal generating means of said video signal for generating a blanking signal, and wherein on the basis of the control information generated by said arithmetic operation control means, said arithmetic operation control means controls said blanking signal generating means so as to generate a blanking signal in an optimum state.

15. An automatic adjusting apparatus of a multi-scan display according to claim 1, wherein said detecting means comprises:

first counting means for counting a scan period of one of said video signals which is supplied to the multi-scan display by clocks of a predetermined frequency;

second counting means for counting a period with a range from a leading edge or a trailing edge of a sync signal that is supplied in association with said video signal to a start position of said one video signal by said clocks; and third counting means for counting a period within a range from the leading edge or the trailing edge of said sync signal to an end position of said one video signal by said clocks.

16. A display apparatus for receiving at least a video signal and-displaying a video image according to said video signal, comprising:

a cathode ray tube (CRT) which includes a screen for displaying said video image;

a video circuit which supplies said video image to said CRT based on said video signal;

a deflection circuit for controlling deflection coils of said CRT based on said video signal; and an automatic adjusting apparatus for adjusting said video image to a predetermined display size and/or a predetermined display position on said screen, wherein said automatic adjusting apparatus comprises:

a detector which detects a scanning period of said video signal, a display start position and a display end position, an arithmetic operation control circuit which calculates a ratio Y of a video display period over one of a horizontal scanning period and/or a vertical scanning period and a ratio X of a front porch period over one of a horizontal scanning period and/or a vertical scanning period based on information output from said detector and generates control information to set said video image displayed on the screen to said predetermined display size and said predetermined display position based only on the calculated ratios, and a converter which converts said control information supplied from said arithmetic operation control circuit to a control voltage or current, and outputs said control voltage or current to said deflection circuit as a control signal of said deflection circuit.

17. A display apparatus according to claim 16, wherein said automatic adjusting apparatus further comprises:

a register which holds control information as an output of said arithmetic operation control circuit, and wherein when control information corresponding to said video signal exists in said register, said arithmetic operation control circuit does not execute the calculation of the ratios X and Y and generation of the control information, but reads out the control information to be stored into said register, and therefore only when the corresponding control information does not exist in said register does said arithmetic operation control circuit executes the calculation of the ratios X and Y and generation of the control information and, further, writes new control information into said register.

18. A display apparatus according to claim 17, wherein in said register, said video signal and the control information which is stored into said register are made to correspond to each other by the result of the period detection of the video signal of said detector and, further, by an output of a polarity detector of a sync signal associated with the video signal.

19. A display apparatus according to claim 18, wherein on the basis of display timing information extracted from said video signal, said arithmetic operation control circuit also forms control information regarding said video signal, including contrast, brightness, and the like of said video signal that is displayed on the screen.

20. A display apparatus according to claim 18, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

21. A display apparatus according to claim 16, wherein said automatic adjusting apparatus further comprises:

a manual adjusting circuit which supplies manual adjustment information of the display size and/or display position of the video image to said arithmetic operation control circuit, and wherein when said manual adjustment information is supplied to said arithmetic operation control circuit, priority is given to said manual adjustment information and the control information regarding the display of said video image being formed.

22. A display apparatus according to claim 21, wherein on the basis of display timing information extracted from said video signal, said arithmetic operation control circuit also forms control information regarding said video signal, including contrast, brightness, and the like of said video signal that is displayed on the screen.

23. A display apparatus according to claim 21, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

24. A display apparatus according to claim 17, wherein said automatic adjusting apparatus further comprises:

a manual adjusting circuit which supplies manual adjustment information of the display size and/or display position of the video image to said arithmetic operation control circuit, and wherein when said manual adjustment information is supplied to said arithmetic operation control circuit, priority is given to said manual adjustment information and the control information regarding the display of said video image being formed.

25. A display apparatus according to claim 24, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

26. A display apparatus according to claim 16, wherein on the basis of display timing information extracted from said video signal, said arithmetic operation control circuit also forms control information regarding said video signal, including contrast, brightness, and the like of said video signal that is displayed on the screen.

27. A display apparatus according to claim 26, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

28. A display apparatus according to claim 16, wherein said automatic adjusting apparatus further comprises:

a blanking signal generating circuit which generates a blanking signal of said video signal, and wherein on the basis of said control information generated by said arithmetic operation control circuit, said arithmetic operation control circuit controls said blanking signal generating circuit so as to generate a blanking signal in an optimum state.

29. A display apparatus according to claim 17, wherein on the basis of display timing information extracted from said video signal, said arithmetic operation control circuit also forms control information regarding said video signal, including contrast, brightness, and the like of said video signal that is displayed on the screen.

30. A display apparatus according to claim 17, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

31. A display apparatus according to claim 16, wherein said detector comprises:

a first counter which counts a scan period of one of said video signals which is supplied to the CRT by clocks of a predetermined frequency;

a second counter which counts a period with a range from a leading edge or a trailing edge of a sync signal that is supplied in association with said video signal to a start position of said one video signal by said clocks; and a third counter which counts a period within a range from the leading edge or the trailing edge of said sync signal to an end position of said one video signal by said clocks.

32. A display apparatus for receiving at least a video signal and displaying a video image according to said video signal, comprising:

a display which includes a screen for displaying said video image;

a video circuit which supplies said video image to said display based on said video signal; and an automatic adjusting apparatus for adjusting said video image to a predetermined display size and/or a predetermined display position on said screen, wherein said automatic adjusting apparatus comprises:

a detector which detects a scanning period of said video signal, a display start position and a display end position, an arithmetic operation control circuit which calculates a ratio Y of a video display period over one of a horizontal scanning period and/or a vertical scanning period and a ratio X of a front porch period over one of a horizontal scanning period and/or a vertical scanning period based on information output from said detector and generates control information to set said video image displayed on the screen to said predetermined display size and/or said predetermined display position based only on the calculated ratios, and a converter which converts said control information supplied from said arithmetic operation control circuit to a control voltage or current, and outputs said control voltage or current to said display as a control signal of said display.

33. A display apparatus according to claim 32, wherein said automatic adjusting apparatus further comprises:

a register which holds control information as an output of said arithmetic operation control circuit, and wherein when control information corresponding to said video signal exists in said register, said arithmetic operation control circuit does not execute the calculation of the ratios X and Y and generation of the control information, but reads out the control information to be stored into said register, and therefore only when the corresponding control information does not exist in said register does said arithmetic operation control circuit executes the calculation of the ratios X and Y and generation of the control information and, further, writes new control information into said register.

34. A display apparatus according to claim 33, wherein in said register, said video signal and the control information which is stored into said register are made to correspond to each other by the result of the period detection of the video signal of said detector and, further, by an output of a polarity detector of a sync signal associated with the video signal.

35. A display apparatus according to claim 34, wherein on the basis of display timing information extracted from said video signal, said arithmetic operation control circuit also forms control information regarding said video signal, including contrast, brightness, and the like of said video signal that is displayed on the screen.

36. A display apparatus according to claim 34, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

37. A display apparatus according to claim 32, wherein said automatic adjusting apparatus further comprises:

a manual adjusting circuit which supplies manual adjustment information of the display size and/or display position of the video image to said arithmetic operation control circuit, and wherein when said manual adjustment information is supplied to said arithmetic operation control circuit, priority is given to said manual adjustment information and the control information regarding the display of said video image being formed.

38. A display apparatus according to claim 37, wherein on the basis of display timing information extracted from said video signal, said arithmetic operation control circuit also forms control information regarding said video signal, including contrast, brightness, and the like of said video signal that is displayed on the screen.

39. A display apparatus according to claim 37, wherein said automatic adjusting apparatus further comprises:

a blanking signal generating circuit which generates a blanking signal of said video signal, and wherein on the basis of the control information generated by said arithmetic operation control circuit, said arithmetic operation Control circuit controls said blanking signal generating circuit so as to generate a blanking signal in an optimum state.

40. A display apparatus according to claim 32, wherein on the basis of display timing information extracted from said video signal, said arithmetic operation control circuit also forms control information regarding said video signal, including contrast, brightness, and the like of said video signal that is displayed on the screen.

41. A display apparatus according to claim 40, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

42. A display apparatus according to claim 32, wherein said detector comprises:

a first counter which counts a scan period of one of said video signals which is supplied to the CRT by clocks of a predetermined frequency;

a second counter which counts a period with a range from a leading edge or a trailing edge of a sync signal that is supplied in association with said video signal to a start position of said one video signal by said clocks; and a third counter which counts a period within a range from the leading edge or the trailing edge of said sync signal to an end position of said one video signal by said clocks.

43. An apparatus according to claim 42, further comprising:

a register which holds control information as an output of said arithmetic operation control circuit, and wherein when control information corresponding to said video signal exists in said register, said arithmetic operation control circuit does not execute the calculation of the ratios X and Y and generation of the control information, but reads out the control information to be stored into said register, and therefore only when the corresponding control information does not exist in said register does said arithmetic operation control circuit executes the calculation of the ratios X and Y and generation of the control information and, further, writes new control information into said register.

44. An apparatus according to claim 43, wherein on the basis of display timing information extracted from said video signal, said arithmetic operation control circuit also forms control information regarding said video signal, including contrast, brightness, and the like of said video signal that is displayed on the screen.

45. An apparatus according to claim 43, further comprising:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

46. An apparatus according to claim 42, wherein on the basis of display timing information extracted from said video signal, said arithmetic operation control circuit also forms control information regarding said video signal, including contrast, brightness, and the like of said video signal that is displayed on the screen.

47. A apparatus according to claim 42, further comprising:

a blanking signal generating circuit which generates a blanking signal of said video signal, and wherein on the basis of said control information generated by said arithmetic operation control circuit, said arithmetic operation control circuit controls said blanking signal generating circuit so as to generate a blanking signal in an optimum state.

48. An apparatus according to claim 42, wherein said detector comprises:

a first counter which counts a scan period of one of said video signals which is supplied to the CRT by clocks of a predetermined frequency;

a second counter which counts a period with a range from a leading edge or a trailing edge of a sync signal that is supplied in association with said video signal to a start position of said one video signal by said clocks; and a third counter which counts a period within a range from the leading edge or the trailing edge of said sync signal to an end position of said one video signal by said clocks.

49. A display apparatus according to claim 33, wherein said automatic adjusting apparatus further comprises:

a manual adjusting circuit which supplies manual adjustment information of the display size and/or display position of the video image to said arithmetic operation control circuit, and wherein when said manual adjustment information is supplied to said arithmetic operation control circuit, priority is given to said manual adjustment information and the control information regarding the display of said video image being formed.

50. A display apparatus according to claim 49, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

51. A display apparatus according to claim 49, wherein on the basis of display timing information extracted from said video signal, said arithmetic operation control circuit also forms control information regarding said video signal, including contrast, brightness, and the like of said video signal that is displayed on the screen.

52. A display apparatus according to claim 32, wherein said automatic adjusting apparatus further comprises:

a blanking signal generating circuit which generates a blanking signal of said video signal, and wherein on the basis of said control information generated by said arithmetic operation control circuit, said arithmetic operation control circuit controls said blanking signal generating circuit so as to generate a blanking signal in an optimum state.

53. A display apparatus according to claim 33, wherein said automatic adjusting apparatus further comprises:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

54. An apparatus according to claim 42, further comprising:

a manual adjusting circuit which supplies manual adjustment information of the display size and display position of the video image to said arithmetic operation control circuit, and wherein when said manual adjustment information is supplied to said arithmetic operation control circuit, priority is given to said manual adjustment information and the control information regarding the display of said video image being formed.

55. An apparatus according to claim 54, further comprising:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

56. An automatic adjusting apparatus of a display which receives at least a video signal and displays a video image according to said video signal on a screen, said apparatus comprising:

a detector for detecting a scanning period of said video signal, a display start position and a display end position;

an arithmetic operation control circuit which calculates a ratio Y of a video display period over one of a horizontal scanning period and/or a vertical scanning period and a ratio X of a front porch period over one of a horizontal scanning period and/or a vertical scanning period based on information output from said detector and generates control information to set said video image displayed on the screen to a predetermined display size and/or a predetermined display position based only on the calculated ratios; and a converter which converts said control information supplied from said arithmetic operation control circuit to a control voltage or current, and for outputting said control voltage or current to the display as a control signal of the display.

57. An apparatus according to claim 56, wherein in said register, said video signal and the control information which is stored into said register are made to correspond to each other by the result of the period detection of the video signal of said detector and, further, by an output of a polarity detector of a sync signal associated with the video signal.

58. An apparatus according to claim 32, wherein on the basis of display timing information extracted from said video signal, said arithmetic operation control circuit also forms control information regarding said video signal, including contrast, brightness, and the like of said video signal that is displayed on the screen.

59. An apparatus according to claim 57, further comprising:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

60. An apparatus according to claim 56, further comprises:

a manual adjusting circuit which supplies manual adjustment information of the display size and display position of the video image to said arithmetic operation control circuit, and wherein when said manual adjustment information is supplied to said arithmetic operation control circuit, priority is given to said manual adjustment information and the control information regarding the display of said video image being formed.

61. An apparatus according to claim 59, further comprising:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

62. An apparatus according to claim 56, wherein on the basis of display timing information extracted from said video signal, said arithmetic operation control circuit also forms control information regarding said video signal, including contrast, brightness, and the like of said video signal that is displayed on the screen.

63. An apparatus according to claim 56, further comprising:

a blanking signal generating circuit which generates a blanking signal of said video signal, and wherein on the basis of the control information generated by said arithmetic operation control circuit, said arithmetic operation control circuit controls said blanking signal generating circuit so as to generate a blanking signal in an optimum state.

64. An apparatus according to claim 1, further comprising blanking signal generating means of said video signal for generating a blanking signal, and wherein on the basis of said control information generated by said arithmetic operation control means, said arithmetic operation control means controls said blanking signal generating means so as to generate a blanking signal in an optimum state.

* * * * *

UNITED STATES PATENT AND TRADEMARK OFFICE

CERTIFICATE OF CORRECTION

PATENT NO. : 5,579,029

DATED : November 26, 1996

INVENTOR(S) : I. Arai, et al.

It is certified that error appears in the above-identified patent and that said Letters Patent is hereby corrected as shown below:

On the title page, left-hand column, after "[22] Filed: Jun. 5, 1995" insert new line:

-- [30] Foreign Application Priority Data
August 1, 1991 [JP] Japan ..... 03-214209 --

Signed and Sealed this

Twenty-sixth Day of August, 1997

*Attest:*

Bruce Lehman

BRUCE LEHMAN

*Attesting Officer*

*Commissioner of Patents and Trademarks*